US005955712A

United States Patent [19]

Zakutin

[11] Patent Number: 5,955,712

[45] **Date of Patent: *Sep. 21, 1999**

[54] INERTIAL SWITCH

[76] Inventor: David Zakutin, 170 University Avenue West, Suite 12-103, Waterloo, Canada, N2L 3E9

[ * ] Notice: This patent is subject to a terminal disclaimer.

[21] Appl. No.: 09/123,384

[22] Filed: Jul. 27, 1998

Related U.S. Application Data

[63] Continuation of application No. 08/742,927, Nov. 1, 1996, Pat. No. 5,786,553.

[51] Int. Cl.[6] ..... H01H 35/14

[52] U.S. Cl. ..... 200/61.48; 200/61.51

[58] Field of Search ..... 200/61.45 R, 61.48, 200/61.49, 61.5, 61.51, 61.52, 61.53, 276, 276.1, 277, 277.1

[56] References Cited

U.S. PATENT DOCUMENTS

| | | | |
|---|---|---|---|
| 2,983,800 | 5/1961 | Rabinow | 200/61.51 X |
| 3,163,856 | 12/1964 | Kirby | 200/61.45 R |
| 3,649,787 | 3/1972 | Kasabian | 200/61.45 R |
| 3,731,022 | 5/1973 | Loftus | 200/61.51 X |
| 3,781,496 | 12/1973 | Jones, Sr. | 200/61.51 X |
| 3,795,780 | 3/1974 | Lawrie | 200/61.51 |
| 4,104,493 | 8/1978 | Hibino et al. | 200/61.48 X |
| 4,201,898 | 5/1980 | Jones et al. | 200/61.45 R |
| 4,272,662 | 6/1981 | Simpson | 200/275 |
| 4,433,223 | 2/1984 | Larson et al. | 200/5 A |
| 4,775,948 | 10/1988 | Dial et al. | 364/565 |
| 4,942,386 | 7/1990 | Willis | 200/61.49 X |
| 5,199,705 | 4/1993 | Jenkins et al. | 473/415 |
| 5,393,974 | 2/1995 | Jee | 250/222.1 |
| 5,761,096 | 6/1998 | Zakutin | 364/565 |
| 5,786,553 | 7/1998 | Zakutin | 200/61.48 |

FOREIGN PATENT DOCUMENTS

| | | |
|---|---|---|
| 28 24 619 | 12/1978 | Germany . |
| 2 269 478 | 2/1994 | United Kingdom . |

*Primary Examiner*—J. R. Scott
*Attorney, Agent, or Firm*—Connolly & Hutz

[57] ABSTRACT

An inertial switch includes an open-ended outer casing formed of electrically conductive material. An insulated end cap is engageable with the open end of the outer casing to enclose the outer casing. An electrically conductive pin extends through the end cap and into the casing and is electrically isolated from the outer casing by the end cap. A longitudinally extending helical coil spring is secured to the pin adjacent one end thereof. The spring is electrically isolated from the outer casing but is deflectable about a longitudinal axis thereof to contact the outer casing thereby to close the inertial switch in response to accelerations of the inertial switch.

21 Claims, 2 Drawing Sheets

INERTIAL SWITCH

CROSS-REFERENCE TO RELATED APPLICATION

This application is a continuation of application Ser. No. 08/742,927, filed Nov. 1, 1996, now U.S. Pat. 5,786,553.

FIELD OF THE INVENTION

The present invention relates to switches and in particular to an inertial switch actuable between open and closed conditions in response to accelerations.

BACKGROUND OF THE INVENTION

Inertial switches movable between open and closed conditions in response to accelerations are well known and have been used in a wide variety of applications. Conventional inertial switches include inner and outer electrically isolated terminals. A spring is attached to the inner terminal and a mass is coupled to the spring. When the inertial switch undergoes an acceleration above a threshold value, the spring and mass system undergo movement which results in the inner and outer terminals being electrically connected thereby closing the inertial switch. The closure of the inertial switch can be used to trigger another event.

Unfortunately, these conventional inertial switches which include separate spring and mass systems are expensive to manufacture and are prone to mechanical failure. In an attempt to overcome these disadvantages, an inertial switch obviating the need for a separate mass has been developed and is described in U.S. Pat. No. 4,201,898 to Jones et al. The Jones et al. inertial switch includes a resilient spiral spring attached at one end to an adjustable post. The free end of the spiral spring is movable to contact an outer housing surrounding the spring to close the inertial switch when the inertial switch undergoes an acceleration.

Although the Jones et al. inertial switch does not have a mass coupled to the spring making it less prone to mechanical failure, the use of a spiral spring which moves to contact the outer housing in response to bending stresses applied to the spring as a result of an applied acceleration, decreases the sensitivity of the inertial switch. Accordingly, improved inertial switches which are inexpensive to manufacture, sensitive and exhibit longevity are sought.

It is therefore an object of the present invention to provide a novel inertial switch.

SUMMARY OF THE INVENTION

According to one aspect of the present invention there is provided an inertial switch comprising:

an outer casing having at least one electrically conductive interior surface defining one terminal of said inertial switch;

an electrically conductive spring member within said outer casing defining another terminal of said inertial switch; and a support to support said spring member within said outer casing in an electrically insulated manner, said spring member having a longitudinal axis and being supported adjacent one end thereof, said spring member deflecting about said longitudinal axis in response to accelerations of said inertial switch to contact said at least one conductive surface and thereby close said inertial switch.

In a preferred embodiment, the spring member is in the form of a helical coil spring. The coil spring is secured at one end thereof to a conductive pin extending through and supported by an insulated cap on one end of the outer casing. In one embodiment, the coil spring is secured to the pin by electrically conductive adhesive. Alternatively, the coil spring can be soldered or welded to the pin provided care is taken to ensure that the deflection characteristics of the spring are not adversely affected.

It is also preferred that the outer casing is formed entirely of electrically conductive material. The coil spring and the interior surfaces of the outer casing may optionally be coated with a highly conductive coating to provide a low contact resistance between the coil spring and the outer casing when the spring deflects and contacts the outer casing.

According to still yet another aspect of the present invention there is provided an inertial switch comprising:

a tubular body having at least one electrically conductive interior surface and defining one terminal of said inertial switch; and a second electrically conductive terminal extending through an end of said tubular body and being electrically isolated therefrom, said second terminal including a longitudinally extending spring member within said body having one end thereof fixed relative to said body, said spring member being deflectable about a longitudinal axis thereof in response to accelerations of said inertial switch to contact said tubular body and thereby close said inertial switch.

According to still yet another aspect of said present invention there is provided an inertial switch comprising:

an outer casing formed of electrically conductive material and defining one terminal of said inertial switch;

an insulated end cap engageable with an open end of said outer casing to enclose said outer casing;

an electrically conductive pin extending through said end cap and into said casing, said pin being electrically isolated from said outer casing; and a longitudinally extending spring member secured to said pin adjacent one end thereof, said spring member being electrically isolated from said outer casing but being deflectable about a longitudinal axis thereof to contact said outer casing thereby to close said inertial switch in response to accelerations of said inertial switch.

The present invention provides advantages in that the inertial switch is of a simple yet elegant design and is light-weight making the inertial switch less prone to mechanical failure and inexpensive to manufacture. This is achieved by using a spring member which constitutes the spring, damper, mass and an electrical contact of the inertial switch.

BRIEF DESCRIPTION OF THE DRAWINGS

An embodiment of the present invention will now be described more fully with reference to the accompanying drawings in which.

DETAILED DESCRIPTION OF THE PREFERRED EMBODIMENT

Figure 1A:
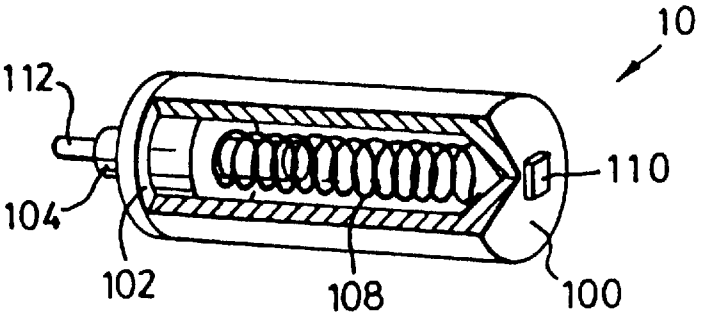
FIG. 1*a* is a perspective view, partially cut-away, of an inertial switch in accordance with the present invention.
Figure 1B:
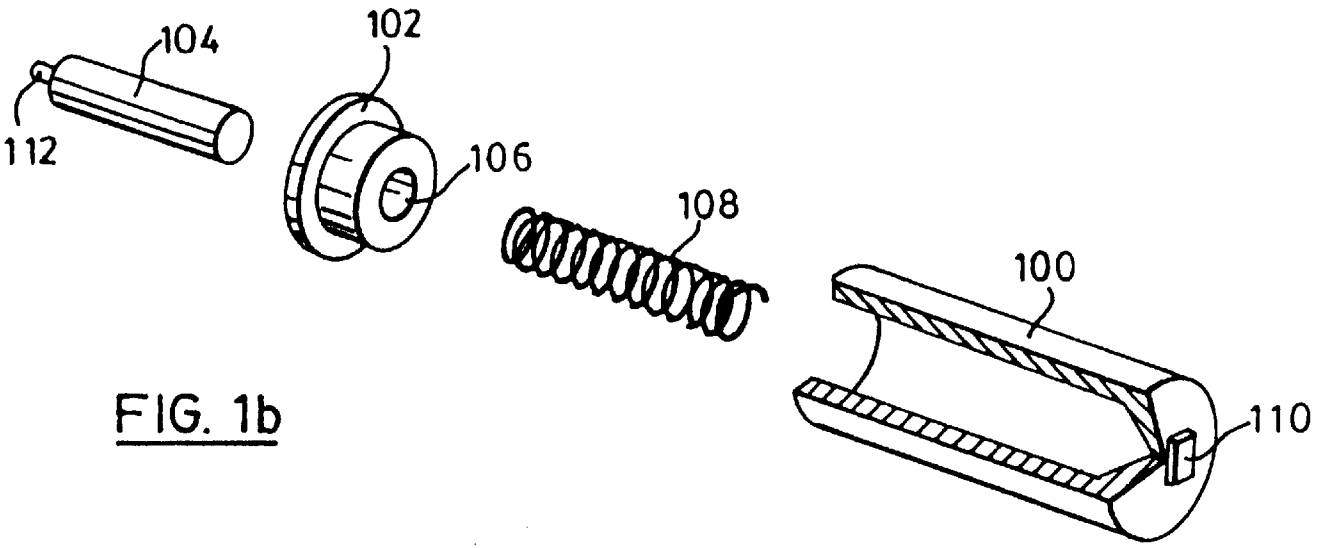
FIG. 1*b* is an exploded perspective partially cut-away of the inertial switch of FIG. 1*a;*
Figure 2A:
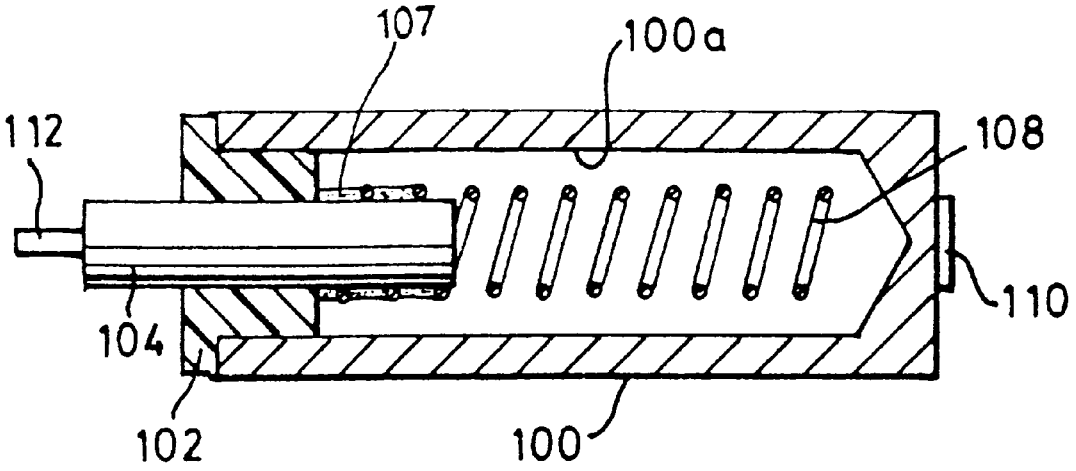
FIG. 2*a* is a cross-sectional view of the inertial switch of FIG. 1*a* in an open condition.
Figure 2B:
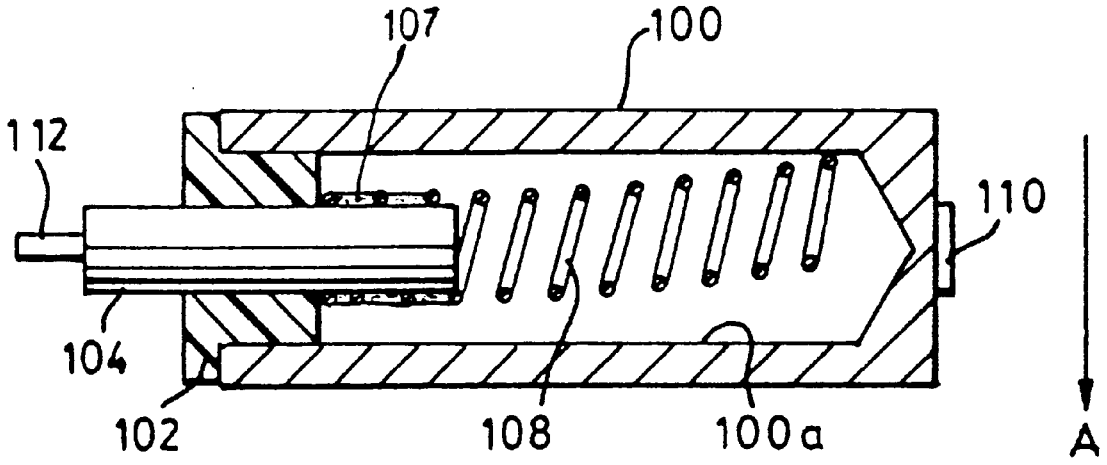
FIG. 2*b* is a cross-sectional view of the inertial switch of FIG. 1*a* in a closed condition.

Referring now to FIGS. 1*a* to 2*b,* a passive, open-ended inertial switch in accordance with the present invention is shown and is generally indicated to by reference numeral 10. Inertial switch 10 is two-dimensionally sensitive to accelerations and moves between open and closed conditions in response to accelerations above a predetermined threshold value. The inertial switch 10 is totally enclosed and is of a simple, light-weight design making it less prone to mechanical failure and inexpensive to manufacture as compared to prior art inertial switches. Further details of the inertial switch 10 and its operation will now be described.

As can be seen inertial switch 10 includes a generally cylindrical, casing 100 formed of electrically conductive material such as for example stainless steel. A plastic end cap 102 is press-fitted into one end of the casing 100. An electrically conductive pin 104 is press-fitted into a central hole 106 in the end cap 102 and extends axially into the interior casing. The end cap 102 electrically isolates the pin 104 and the casing 100. An electrically conductive, helical coil spring 108 within the casing 100 is secured at one end thereof to the pin 104 by way of electrically conductive adhesive 107. The free end of the spring 108 floats within the casing 100 and typically remains spaced from the interior surfaces 100*a* of the casing to maintain the pin 104 and casing 100 in electrical isolation. Successive coils of the spring are spaced apart so that the spring deflects as a result of torsion rather then bending stresses when the inertial switch undergoes an acceleration. This allows the inertial switch to be sensitive to small accelerations.

The spring 108 and interior surfaces 100*a* of the casing are optionally plated with a highly electrically conductive coating such as for example gold to provide a low contact resistance between the spring 108 and the casing 100 when the spring and casing contact one another. If the interior surfaces of the casing 100 are to be plated with a highly conductive coating, it is preferred that the casing be formed of a tubular body and a separate end piece secured to the body at one end. During plating, the nature of the tubular body facilitates the flow of the liquid plating through the body thereby enhancing migration of the liquid plating and helping to ensure a suitable coating. A tab 110 is laser welded on the end of casing 100 and a tab 12 is laser welded on the pin 104. The tabs 110 and 112 facilitate the connection of electrical leads to the inertial switch 10 to allow the inertial switch to be introduced into an electronic or electrical circuit so that openings and closings of the inertial switch can be detected and used to trigger other events.

The sensitivity of the inertial switch can be expressed as:

$$\Delta y \propto \frac{C_d \cdot D \cdot g \cdot L^3 \cdot r_2^2}{r_1^2 \cdot G} \tag{1}$$

where:

$C_d$ is the coil density of the spring in coils/unit length;

D is the density of the spring material;

g is the acceleration applied to the inertial switch neglecting gravity;

L is the free length of the spring;

$r_2$ is the wound radius of the spring;

$r_1$ is the wire radius of the spring; and

G is the shear modules of the spring material.

Equation (1) is derived assuming that:

(i) the deflection of the spring is caused entirely by torsion. Deflection due to bending is considered negligible;

(ii) spring deflections are small allowing for trigonometric simplification;

(iii) the spring has constant properties and a generally constant pitch; and (iv) the acceleration vector is constant simplifying the response of the spring to a unidirectional, steady-state response.

Thus, by changing some or all of the parameters of equation (1), the sensitivity of the inertial switch 10 can be altered allowing the sensitivity of the inertial switch to be adjusted to suit the environment in which the inertial switch 10 is used.

In use, the inertial switch 10 is mounted on or within a body that is expected to undergo accelerations and is electrically connected to an electronic or electrical circuit. The inertial switch 10 is oriented and mounted on the body in a manner so that accelerations of the body to be detected, that have vectors directed along the longitudinal axis of the spring are minimized. When the body is accelerated and the acceleration has a vector offset from the longitudinal axis of the spring 108 as shown by arrow "A" in FIG. 2*b,* the spring 108 deflects about the pin 104. If the acceleration is above a predetermined threshold, the spring will deflect and contact the interior surfaces 101*a* of the casing 100 thereby electrically connecting the pin 104 and the casing to close the inertial switch 10. Closing of the inertial switch 10 is detected by the electrical or electronic circuit and can be used to trigger another event.

One particular environment for the inertial switch 10 has been found to be in sports projectiles such as speed-sensing baseballs or the like. Details of the speed-sensing baseball can be found in Applicant's co-pending application entitled "Speed-Sensing Projectile" filed on even date herewith and issued Ser. No. 08/742,920, now U.S. Pat. No. 5,761,096, the contents of which are incorporated herein by reference.

The inertial switch 10 can be of any appropriate size and of course, the size and weight of the inertial switch will vary depending on the environment in which the inertial switch is used. If the frequency response of the spring is found to be under-damped when the physical dimensions of the inertial switch are increased, the spring can be dampened by wetting the spring in a non-conductive fluid such as for example oil.

Although the inertial switch 10 has been described as having the tabs 110 and 112 to allow the electrical leads to be terminated via laser welds, it should be apparent that other standard terminations for the electrical leads such as for example through-the-hole technology or surface mount pads can be used on the inertial switch. In addition, the casing 100, although described as being cylindrical, may be of another geometrical configuration. If through-the-hole technology or surface mount pads are used to terminate the electrical leads, a casing with a generally rectangular profile to present flat surfaces is preferred. Furthermore, although the spring 108 has been described as being attached to the pin by electrically conductive adhesive, other techniques such as soldering or laser welding can be used provided care is taken not to affect adversely the load versus deflection characteristics of the spring 108.

Although the casing has been described as being formed of electrically conductive material, those of skill in the art will appreciate that the casing may of course be formed of electrically non-conductive material which has been coated with electrically conductive material. In addition, the end cap and pin may be integrally formed. In this case, the pin would be tubular and coated on its interior and exterior surfaces with electrically conductive material to allow an electrical connection with the spring to be made.

If desired, the sensitivity of the inertial switch in certain directions can be controlled by changing the conductive nature of the casing in certain areas. This can be achieved by applying non-conductive material to selected areas of the interior surface of the casing, or by selectively coating only certain areas of the casing with electrically conductive material if the casing is formed of non-conductive material.

If desired, the inertial switch 10 can also be adjustable to allow the threshold at which the inertial switch closes in response to accelerations to be changed. In this embodiment, the spring is fixed at one end to a sleeve through which the pin passes. The pin is slidable axially through the end cap and sleeve to allow the length of the pin that extends into the casing and hence into the spring to be adjusted. The further the pin extends into the spring, the less sensitive the inertial switch becomes and therefore, the larger the acceleration becomes that is required to close the inertial switch becomes. In this case, detents co-operate between the pin and the sleeve to limit the extent of movement of the pin into and out of the spring.

Although particular embodiments of the present invention have been described, those of skill in the art will appreciate that variations and modifications may be made thereto without departing from the spirit and scope of the invention as defined by the appended claims.

I claim:

1. An inertial switch comprising:

an outer casing having at least one electrically conductive interior surface defining one terminal of said inertial switch;

an electrically conductive, generally constant diameter helical spring member within said outer casing and defining another terminal of said inertial switch, said spring member having a central longitudinal axis and constituting the moving mass of said inertial switch;

an electrically conductive support extending partially into said outer casing and supporting one end of said spring member, said spring member extending longitudinally beyond said support and being spaced from said at least one conductive surface so as to be electrically isolated therefrom; and an insulator acting between said support and said outer casing, wherein when said inertial switch undergoes an acceleration above a threshold level and having a vector forming an angle with said central longitudinal axis, said spring member deflects to contact said at least one conductive surface and thereby close said inertial switch.

2. The inertial switch as defined in claim 1 wherein said helical spring member has spaced coils so that said spring member deflects in torsion.

3. The inertial switch as defined in claim 1 wherein said support is in the form of a conductive pin and wherein said insulator is in the form of a cap formed of electrically non-conductive material on one end of said outer casing, said pin extending generally centrally through said cap.

4. The inertial switch as defined in claim 3 wherein said helical spring member is secured to said pin by electrically conductive adhesive.

5. The inertial switch as defined in claim 1 wherein said outer casing is formed entirely of electrically conductive material.

6. The inertial switch as defined in claim 5 wherein said helical spring member and said at least one conductive interior surface of said outer casing are coated with a highly conductive coating.

7. The inertial switch as defined in claim 1 wherein said outer casing is formed of electrically non-conductive material and wherein said at least one interior conductive surface is constituted by an electrically conductive coating on said outer casing.

8. The inertial switch as defined in claim 1 wherein selected portions of said at least one conductive interior surface of said outer casing are non-conductive to sensitize said inertial switch in selected directions.

9. The inertial switch as defined in claim 1 further comprising dampening means in the form of a non-conductive fluid on said spring member.

10. An inertial switch comprising:

a tubular body formed of electrically conductive material to define an electrically conductive interior and constituting one conductive terminal of said inertial switch;

a second electrically conductive terminal extending partially into said tubular body;

an insulator acting between said body and said conductive second terminal; and a longitudinally extending electrically conductive, constant diameter, helical spring member within said body having one end thereof fixed to said second terminal and constituting the moving mass of said inertial switch, said spring member extending longitudinally beyond said second terminal and being spaced from said body, wherein when said inertial switch undergoes an acceleration above a threshold level and having a vector forming an angle with a longitudinal axis of said spring member, said spring member deflects to contact said body and thereby close said inertial switch.

11. The inertial switch as defined in claim 10 wherein said helical spring member has spaced coils so that said spring member deflects in torsion.

12. The inertial switch as defined in claim 10 wherein said support is in the form of a conductive pin and wherein said insulator is in the form of a cap formed of electrically non-conductive material on one end of said body, said pin extending centrally through said cap.

13. The inertial switch as defined in claim 12 wherein said spring member is fixed to said pin by electrically conductive adhesive.

14. The inertial switch as defined in claim 10 wherein said helical spring member and the interior of said body are coated with a highly conductive coating.

15. An inertial switch comprising:

an outer, cylindrical casing formed of electrically conductive material and defining one terminal of said inertial switch;

an insulating end cap engageable with an open end of said outer casing to enclose said outer casing;

an electrically conductive pin extending through said end cap and partially into said casing, said end cap electrically isolating said pin from said outer casing; and a longitudinally extending, electrically conductive, constant diameter, helical spring member having one end secured to said pin and constituting the moving mass of said inertial switch, said spring member extending longitudinally beyond said pin and being electrically isolated from said outer casing, wherein when said inertial switch undergoes an acceleration above a threshold level and having a vector forming an angle with a longitudinal axis of said spring member, said spring member deflects to contact said outer casing thereby to close said inertial switch.

16. The inertial switch as defined in claim 15 wherein said spring member has spaced coils so that said spring member deflects in torsion.

17. The inertial switch as defined in claim 16 wherein said spring member is secured to said pin by electrically conductive adhesive.

18. The inertial switch as defined in claim 15 wherein said spring member and the interior of said outer casing are coated with a highly conductive coating.

19. An inertial switch comprising:

an outer, generally cylindrical casing having at least one electrically conductive interior surface defining one terminal of said inertial switch;

an electrically conductive helical, constant diameter spring within said outer casing defining another terminal of said inertial switch; and a support to support said helical spring within said outer casing in an electrically insulated manner, said helical spring having a longitudinal axis and being supported adjacent one end thereof, said helical spring deflecting about said longitudinal axis in response to accelerations of said inertial switch to contact said at least one conductive surface and thereby close said inertial switch.

20. An inertial switch comprising:

a tubular body having at least one electrically conductive interior surface and defining one terminal of said inertial switch; and a second electrically conductive terminal extending through an end of said tubular body and being electrically isolated therefrom, said second terminal including a longitudinally extending helical, constant diameter spring within said body having one end thereof fixed relative to said body, said helical spring being deflectable about a longitudinal axis thereof in response to accelerations of said inertial switch to contact at least one electrically conductive surface and thereby close said inertial switch.

21. An inertial switch comprising:

an outer casing formed of electrically conductive material and defining one terminal of said inertial switch;

an insulated end cap engageable with an open end of said outer casing to enclose said outer casing;

an electrically conductive pin extending through said end cap and into said casing, said pin being electrically isolated from said outer casing; and a longitudinally extending constant diameter spring member secured to said pin adjacent one end thereof, said spring member being electrically isolated from said outer casing but being deflectable about a longitudinal axis thereof to contact said outer casing thereby to close said inertial switch in response to accelerations of said inertial switch.

* * * * *